US008701786B2

(12) United States Patent
Galle et al.

(10) Patent No.: US 8,701,786 B2
(45) Date of Patent: Apr. 22, 2014

(54) POSITIONLESS EXPANDING LOCK RING FOR SUBSEA ANNULUS SEALS FOR LOCKDOWN

(75) Inventors: Gary Galle, Houston, TX (US); Marc Minassian, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 501 days.

(21) Appl. No.: 13/072,407

(22) Filed: Mar. 25, 2011

(65) Prior Publication Data

US 2012/0241175 A1 Sep. 27, 2012

(51) Int. Cl.
*E21B 33/04* (2006.01)

(52) U.S. Cl.
USPC ..... 166/379; 166/208; 166/368

(58) Field of Classification Search
USPC ..... 166/379, 75.14, 75.13, 368, 85.3, 208; 277/323, 328
See application file for complete search history.

(56) References Cited

U.S. PATENT DOCUMENTS 5,174,376 A 12/1992 Singeetham
5,725,056 A 3/1998 Thomson
2010/0116489 A1 5/2010 Nelson
2010/0147533 A1 6/2010 Nelson
2010/0300705 A1* 12/2010 Nelson ..... 166/387

FOREIGN PATENT DOCUMENTS

EP 2189620 A1 5/2010
EP 2314828 A2 4/2011
GB 2482392 A 2/2012

OTHER PUBLICATIONS

Search Report from corresponding GB Application No. GB1205076.1 dated Jul. 2, 2012.

* cited by examiner

*Primary Examiner* — David Andrews
(74) *Attorney, Agent, or Firm* — Bracewell & Giuliani LLP

(57) ABSTRACT

Wellhead assemblies, seal assemblies, and methods of locking down an annulus seal disposed within an annulus between outer and inner wellhead members, are provided. A seal assembly is positioned in an annulus. An energizing member is axially translated downward to energize an annulus seal element and outwardly radially compress a high-strength lockdown member into contact with an inner diameter surface of a wellhead member. The wellhead member can include a set of wickers. During compression, the outer diameter surface of the lockdown member is plastically deformed onto the set of wickers.

21 Claims, 6 Drawing Sheets

POSITIONLESS EXPANDING LOCK RING FOR SUBSEA ANNULUS SEALS FOR LOCKDOWN

BACKGROUND OF THE INVENTION

1. Field of the Invention

This invention relates in general to wellhead assemblies and in particular to modified wellhead members and new seal assemblies for sealing between inner and outer wellhead members.

2. Description of the Related Art

Seals are used between inner and outer wellhead tubular members to contain internal well pressure. The inner wellhead member may be a casing hanger that supports a string of casing extending into the well for the flow of production fluid. The casing hanger lands in an outer wellhead member, which may be a wellhead housing, a Christmas tree, or a casing head. A packoff (or other seal assembly) seals the annulus between the casing hanger and the outer wellhead member. Alternately, the inner wellhead member can be a tubing hanger located in a wellhead housing and secured to a string of casing extending into the well. A pack off (or other seal assembly) seals the annulus between the tubing hanger and the wellhead housing.

A variety of annulus seals of this nature have been employed. Conventional annulus seals include, for example, elastomeric and partially metal and elastomeric rings. Prior art seal rings made entirely of metal for forming metal-to-metal seals are also employed. The seals may be set by a running tool or they may be set in response to the weight of the string of casing or tubing. One type of metal-to-metal seal has inner and outer walls separated by a conical slot. An energizing ring is pushed into the slot to deform the inner and outer walls apart into sealing engagement with the inner and outer wellhead members. The energizing ring is a solid wedge-shaped member. The deformation of the inner and outer walls exceeds the yield strength of the material of the seal ring, making the deformation permanent.

Thermal growth between the casing or tubing and the wellhead may occur. The well fluid flowing upward through the tubing heats the string of tubing, and to a lesser degree the surrounding casing. The temperature increase may cause the tubing hanger and/or casing hanger to move axially a slight amount relative to the outer wellhead member or each other. During the heat up transient, the casing hanger and/or tubing hanger can also move radially due to temperature differences between components and the different rates of thermal expansion from which the component materials are constructed. If the seal has been set as a result of a wedging action where an axial displacement of energizing rings induces a radial movement of the seal against its mating surfaces, then sealing forces may be reduced if there is movement in the axial direction due to pressure or thermal effects. A reduction in axial force on the energizing ring results in a reduction in the radial inward and outward forces on the inner and outer walls of the seal ring, which may cause the seal to leak. A loss of radial loading between the seal and its mating surfaces due to thermal transients may also cause the seal to leak.

Lockdown rings have been employed to assist in maintaining the positioning of the energizing ring. Recognized by the inventors, however, is that prior lockdown ring implementations have generally required an annular groove in the wellhead casing. Such annular groove may not only limit the axial positioning of the lockdown ring, resulting in increased manufacturing costs of the wellhead assembly, but may weaken or otherwise leave an area in the wellhead casing that is more vulnerable to stress, strain, thermal variations, etc.; further increasing manufacturing costs directed to certain components of the wellhead assembly. Additionally, recognized by the inventors is that such locking mechanisms that specifically must match a groove in a high-pressure wellhead housing may be subject to damage and debris fouling during the normal course of drilling operations. Accordingly, recognized is the need for a seal and wellhead assembly which includes a lockdown ring that is not limited to precise axial positioning and that does not require positioning within a groove to maintain its axial positioning. Also recognized by the inventors is that improved lockdown ring performance can be had by using a surface metal that is harder than the metal forming the annulus seal, yet softer than the metal at the wellhead housing-lockdown ring interface to negate a need for a lockdown ring receiving groove.

SUMMARY OF THE INVENTION

In view of the foregoing, various embodiments of the present invention advantageously provide seal assemblies, wellhead assemblies, and methods of locking down an annulus seal positioned between an outer and an inner wellhead members. Various embodiments of the present invention also advantageously provide an annulus seal member energized and driven into the wellhead housing body by an energizing member configured to energize an annulus seal member. Various embodiments of the present invention also advantageously provide a set of wickers extended to be adjacent to the lockdown ring when operationally employed to lock down the annulus seal, which can, for example, provide infinite adjustability within a certain window when setting the casing hanger and annulus seal, without changing the sealing performance or technologies of the annulus seal. Advantageously, when upthrusts are generated at the casing hanger, the load can transfer into both the existing annulus seal member and into the exemplary lockdown ring, thereby providing for load sharing.

More specifically, an example of an embodiment of a wellhead assembly including a seal assembly for locking down an annulus seal, includes an outer wellhead member (e.g., a high-pressure wellhead housing) adapted to be anchored in a borehole, an inner wellhead member (e.g., a casing hangar) landed within the wellhead housing, a gap between the wellhead housing and the casing hanger defining an annulus, a profile on an interior surface of the wellhead housing comprising a set of shallow annular grooves/protuberances defining a set of wickers, and a seal assembly for locking down an annulus seal disposed within the annulus between outer and casing hangers.

The seal assembly according to an exemplary embodiment of the wellhead assembly includes an annulus seal comprising a first annular member configured to engage an outer diameter surface of the casing hanger, a second annular member configured to engage an inner diameter surface of the wellhead housing, and an annular recess or other channel extending therebetween to receive an energizing member.

The seal assembly also includes an annular lockdown member (e.g., lockdown ring) having an outer diameter surface configured to engage adjacent portions of an inner diameter surface of the wellhead housing when operationally positioned therein, an inner diameter surface to engage an outer diameter surface of an energizing member (e.g., energizing ring), and a tapered surface tapered to facilitate axial movement of an outer diameter surface of the energizing ring into engagement with substantial portions of the inner diameter surface of the lockdown ring when axially translating the distal end portion of the energizing ring into the annular channel of the annulus seal.

The lockdown ring is further configured so that when the energizing ring is fully axially translated to energize the annulus seal, portions of the outer diameter surface of the lockdown ring plastically deform onto a plurality of wickers of the set of wickers located on portions of the inner diameter surface of the wellhead housing. The amount of force necessary depends upon the combination of the strength of the lockdown ring and strength of the wicker containing surface of the wellhead housing. The strength rating of the portion of the wellhead housing engaging portions of the outer diameter surface of the lockdown ring is typically between approximately 80 KPsi and 120 Kpsi. Correspondingly, the strength rating of portions of the outer surface diameter of the lockdown ring engaging the portions of the wellhead housing should be set to be between approximately 30 Kpsi and 80 KPsi, but more preferably approximately 30 KPsi below that of the corresponding wellhead housing surface.

The seal assembly also includes the energizing member (e.g., the energizing ring identified above) dimensioned to radially compress substantial portions of the outer diameter surface of the lockdown ring into corresponding portions of the inner diameter surface of the wellhead housing and to energize the annulus seal. The energizing ring includes a proximal end portion having an outer diameter surface sized to engage substantial portions of the inner diameter surface of the annular lockdown ring to radially outwardly compress portions of the lockdown ring when axially translating the distal end portion of the energizing ring into the annular channel of the annulus seal. The energizing ring also includes an adjacent tapered surface complementing the tapered surface of the lockdown ring and tapered at an angle of, e.g., between approximately 3° and 15°, to facilitate axial movement of the outer diameter surface of the proximal end portion of the energizing ring into engagement with the substantial portions of the inner diameter surface of the lockdown ring when axially translating the distal end portion of the energizing ring into the annular channel of the annulus seal.

The energizing ring also includes a distal end portion sized to engage the first annular member and the second annular member of the annulus seal when axially translating the distal end portion of the energizing ring into the annular channel of the annulus seal. The upper section of the distal end portion can have an outer surface diameter that matches the outer surface diameter of the proximal end portion. The energizing ring also includes a medial portion having an outer surface diameter that is less than the outer surface diameter of the proximal end portion of the energizing ring and less than the outer surface diameter of an upper section of the distal end portion of the energizing ring to accommodate the lockdown ring prior to axially translating the distal end portion of the energizing ring into the annular channel of the annulus seal. The medial portion in conjunction with the upper section of the distal end portion form a shoulder configured to engage a bottom surface portion of a retaining member or nut during removal of the seal assembly from within the wellhead housing.

The seal assembly includes a retaining member (e.g., retaining nut) having a tapered surface complementing the tapered surface of the energizing ring and tapered so that when the distal end portion of the energizing ring is fully operationally inserted between the first and second annular members of the annulus seal, the tapered portion of the energizing ring engages the tapered portion of the retainer nut. Correspondingly, the second annular member can include an annular extension, whereby a proximal end of the annular extension is configured to engage complementary portions of the retainer nut.

Various embodiments of the present invention also include methods of locking down an annulus seal disposed within an annulus between outer and inner wellhead members. An example of a method can include the step of providing a seal assembly including an annulus seal, an annular lockdown ring or other member, a retaining nut or other member, and an energizing ring or other member. The steps can also include positioning the seal assembly in the annulus between outer and inner wellhead members, and axially translating a distal end portion of the energizing ring into an annular channel of the annulus seal. The distal end portion of the energizing ring resultingly radially inwardly compresses substantial portions of a first annular member of the annulus seal into engagement with an outer diameter surface of the inner wellhead member and radially outwardly compresses substantial portions of a second annular member of the annulus seal into engagement with an inner diameter surface of the outer wellhead member responsive to the axial translation of the energizing ring. The axial translation of the energizing ring also results in outer diameter surface portions of a proximal end portion of the energizing ring radially outwardly compressing substantial portions of the lockdown ring responsive thereto, whereby substantial portions of the outer diameter surface of the lockdown ring plastically deform onto (and "bite" into) a plurality of annular grooves of a set of annular grooves defining a set of wickers located on portions of the inner diameter surface of the outer wellhead member. Advantageously, such action results in exceptionally strong lockdown forces which negate the need for use of a recess in the outer wellhead member to help hold the lockdown member in position.

According to an embodiment of the method, the energizing ring includes a tapered surface which engages with a tapered surface along the inner diameter of the upper surface of the lockdown ring in order to facilitate passage of the energizing ring into a compressive fit against the inner diameter surface of the lockdown ring resulting from/during axial translation of the energizing member.

According to an embodiment of the method, the retaining nut or other member connects to an annular extension member connected to or integral with the second annular member of the annulus seal. According to such embodiment, the lockdown ring lands upon an upper surface of the retaining nut. Further, the retaining nut has a tapered surface along the inner diameter of an upper portion of the retaining nut which complements the tapered surface of the energizing ring such that, during axial translation, the tapered surface of the energizing ring lands upon the tapered surface of the retaining nut. The tapered surfaces, complementing each other, less prevent the proximal end portion of the energizing ring from translating downward off the inner diameter surface of the lockdown ring when energizing the annulus seal and compressibly loading the lockdown ring to form the lockdown.

The method also includes removing the energizing ring from compressive engagement of the energizing ring with the annulus seal and correspondingly with the lockdown ring in order to remove the seal assembly, when desired. Accordingly, an upper section of the distal end portion of the energizing ring can have an outer surface diameter that is larger than a medial portion outer surface diameter. The diameter differential forms a recess which extends between the tapered portion adjacent proximal end portion of the energizing ring and the upper section of the distal end portion of the energizing ring. The diameter differential also forms a shoulder along the lower portion of the recess, which can engage the bottom surface of the distal extension member of the retaining nut.

Accordingly, during removal operations, the energizing ring is urged upward from its lockdown position, for example, through employment of a running tool. Urging the energizing ring upward extracts the energizer from within the space/channel of the annulus seal. Upwardly urging the energizing ring also, preferably simultaneously, results in the outer proximal surface of the energizing ring sliding off the lockdown ring inner surface, releasing the compressive lockdown forces between energizing ring surface and corresponding wellhead surface, and results in the lockdown ring sliding into the recessed energizing ring surface. Upwardly moving the energizing ring to pull the energizing ring surface off the lockdown ring surface effectively releases the engaged lockdown ring surface from the wickered wellhead member inner diameter surface. Further, with the lockdown ring positioned within the gap formed between recessed energizing ring surface and the wellhead member inner diameter surface, continued extraction forces result in the energizing ring shoulder engaging the bottom surface of the retaining nut. Still further forces result in the removal of the entire seal assembly from within the wellhead.

BRIEF DESCRIPTION OF THE DRAWINGS

So that the manner in which the features and advantages of the invention, as well as others which will become apparent, may be understood in more detail, a more particular description of the invention briefly summarized above may be had by reference to the embodiments thereof which are illustrated in the appended drawings, which form a part of this specification. It is to be noted, however, that the drawings illustrate only various embodiments of the invention and are therefore not to be considered limiting of the invention's scope as it may include other effective embodiments as well.

DETAILED DESCRIPTION

The present invention will now be described more fully hereinafter with reference to the accompanying drawings, which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout. Prime notation, if used, indicates similar elements in alternative embodiments.

Figure 1:
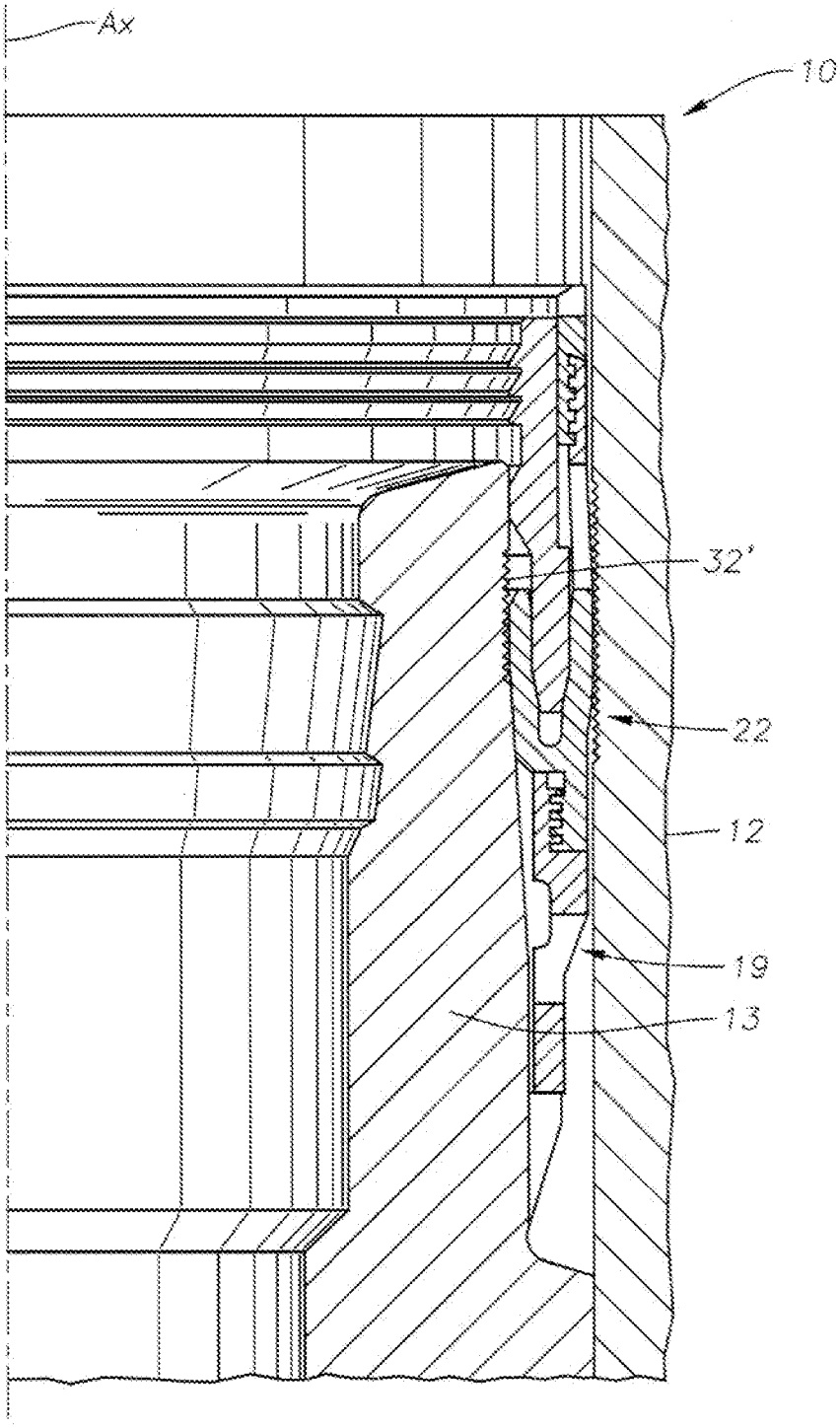
Fig. 1 PRIOR ART
FIG. 1 is a sectional view of portions of a wellhead assembly providing a modification template.

Existing annulus seals such as, for example, that shown in FIG. 1, may not provide enough lockdown capability during certain field conditions, particularly when employed in environmental conditions subject to significant swings in temperature and/or pressure. Lockdown force requirements come from annulus pressure and/or thermal growth of the casing string which then transfers a load into the casing hanger. Accordingly, embodiments of the present invention provide a lockdown member which can provide additional lockdown over and above that available when employing existing seal technology without the need to modify conventional annulus seals and without the need for providing a groove/recess to contain the lockdown member when operationally employed in a lockdown position.

Figure 2:
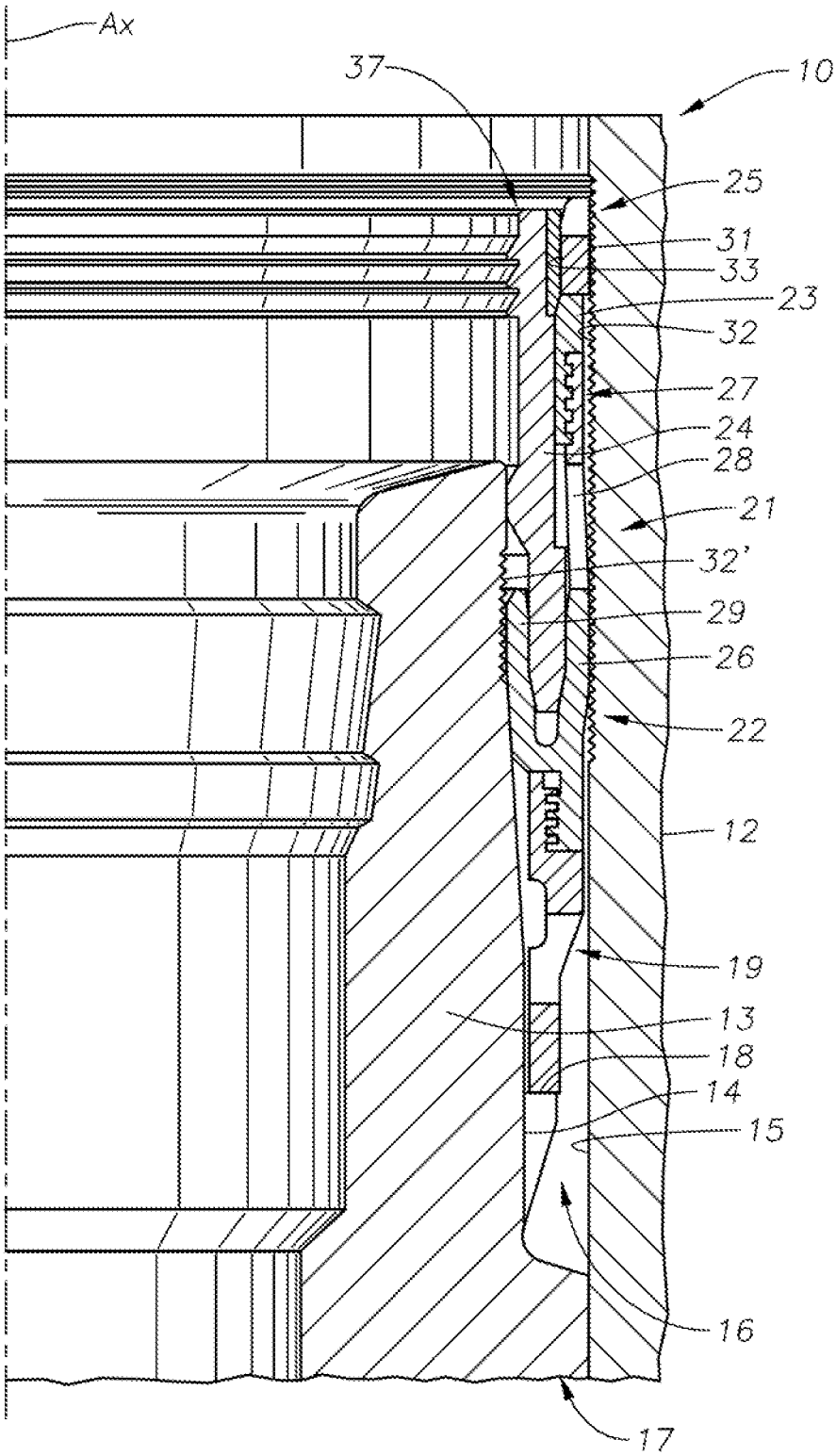
FIG. 2 is a sectional view of portions of a wellhead assembly according to an embodiment of the present invention.

FIG. 2 illustrates, for example, portions of a wellhead assembly 10 including a seal assembly 21 according to an example of an embodiment of the present invention. The wellhead assembly 10 can include a high-pressure wellhead housing 12 affixed at an upper end of a wellbore (not shown) and coaxially circumscribing a casing hanger 13. The spaced apart distance between the respective inner and outer diameter surfaces 14, 15 of the casing hanger 13 and wellhead housing 12, respectively form an annulus 16. Lower portion 17 of the casing hanger 13 transitions to extend outward into contact with the wellhead housing inner diameter surface 16, thereby defining the lower terminal end of the annulus 16. A lockdown shoulder 18 is shown provided in the lower terminal end of annulus 16. The upper surface of lockdown shoulder 18 slopes downward with travel away from the outer diameter surface 17 of the casing hanger 13. A nose ring 19 is shown situated in the annulus 16 resting atop the lockdown shoulder 16. A force parallel to the axis Ax of wellhead assembly 10 produces resultant forces to urge the nose ring 19 upwardly and radially within the annulus 16.

Figure 3:
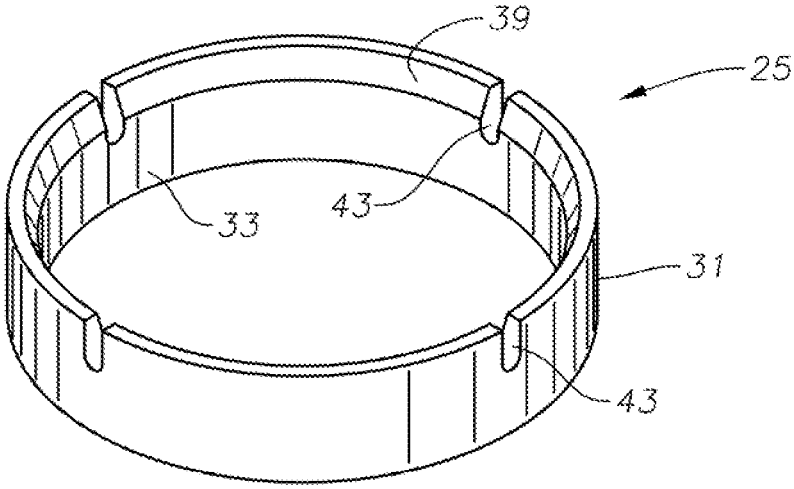
FIG. 3 is a perspective view of a lockdown ring of a wellhead assembly according to an embodiment of the present invention.

A seal assembly 21 is shown in the annulus 16 threadingly affixed to the upper end of nose ring 19 and extending upwardly therefrom. In the embodiment illustrated in FIGS. 2, 6A-6B, and 7A-7B, the seal assembly 21 comprises a seal element or member (e.g., annulus seal 22), a retaining member (e.g., retaining nut 23), an energizing member (e.g., energizing ring 24), and a lockdown member (e.g., lockdown ring 25). In this exemplary embodiment, the lockdown ring 25, configured as shown, for example, in FIG. 3, is comprised of a metal or metal alloy or other strong material, preferably having a strength of at least 35-45 KPSI, but may have a higher strength below the strength of the wellhead housing which is typically 80-120 KPSI.

Still primarily referring to FIG. 2, the seal element 22 includes an outer member 26 shown threaded to the inner coupling of nose ring 19 on its lower end. The seal element 22 may be comprised of metal, soft metal, or an elastomeric material. The outer member 26 extends upward along the inner diameter surface 15 of wellhead housing 12. The outer member 26 includes an extension member 27 having an upper end that terminates in a threaded fitting with the annular nut 23. Thus, the outer member 26 is a generally annular member having a cross-sectional thickness less than the thickness of annulus 16. The extension member portion 27 of outer member 26 includes an optional slot 28 shown provided along a portion of its length. The extension member 27 can comprise resilient load-bearing material, examples of which include steel, metal alloys, and composites.

The seal element 22 further includes an annular inner member 29 shown laterally projecting from the outer member 26 above the inner coupling of nose ring 16. The apex portion of seal element 22 extends from the outer member 26 substantially perpendicular to the axis Ax through the annulus 16. At the casing hanger 13, an outer circumference of inner member 29 angles upward to run generally parallel to the axis Ax. The lockdown ring 25 is shown in contact with the annular nut 23 is also located within the annulus 16 and is coaxial about the axis Ax.

Figure 4:
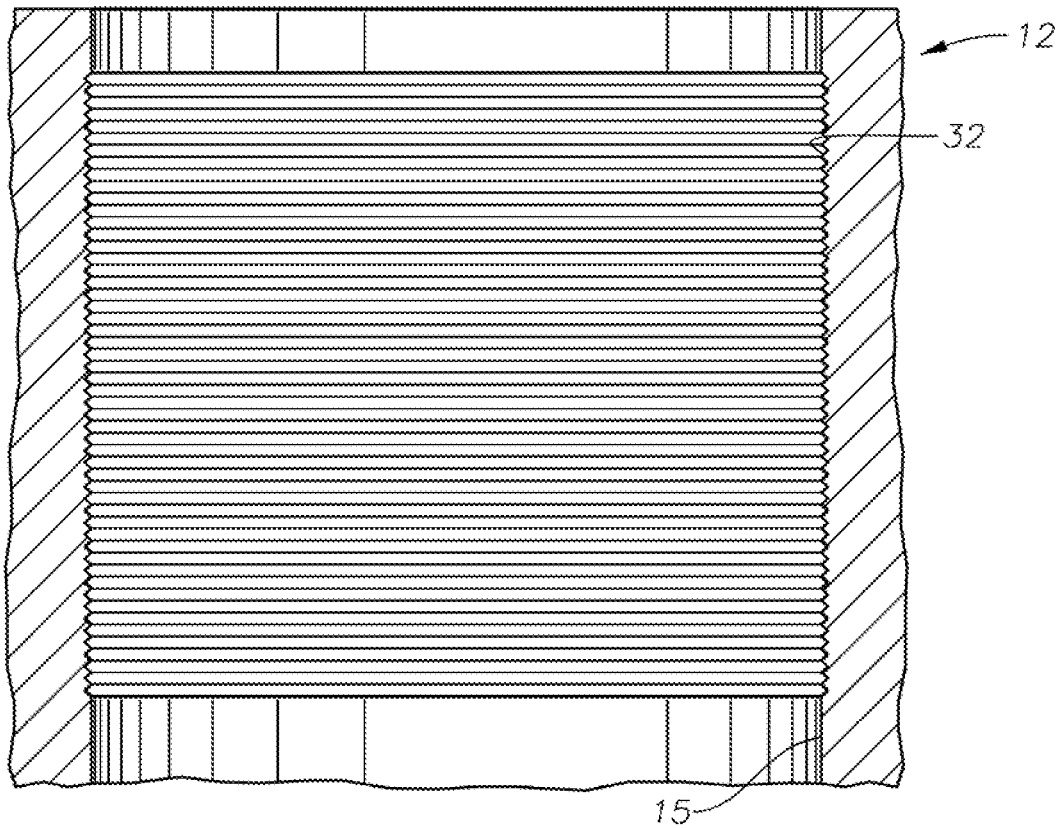
FIG. 4 is a sectional view of a wellhead housing of a wellhead assembly according to an embodiment of the present invention.

The lockdown ring 25 includes an outer diameter surface 31 configured to engage adjacent portions of the inner diameter surface 15 of the wellhead housing 12 having a plurality of shallow annular grooves defining a set of wickers 32 (see, e.g., FIG. 4) when operationally positioned. In the embodiment illustrated in FIG. 3, the outer diameter surface 31 of the lockdown ring 25 is planar along the axis Ax and, in a preferred configuration, is relatively smooth to allow axial transition of the surface 31 of lockdown ring 25 across the inner diameter surface 15 of the wellhead housing 12 prior to being subjected to a radially outwardly compressive force by energizing ring 24 (see, e.g., FIG. 5).

Figure 6A:
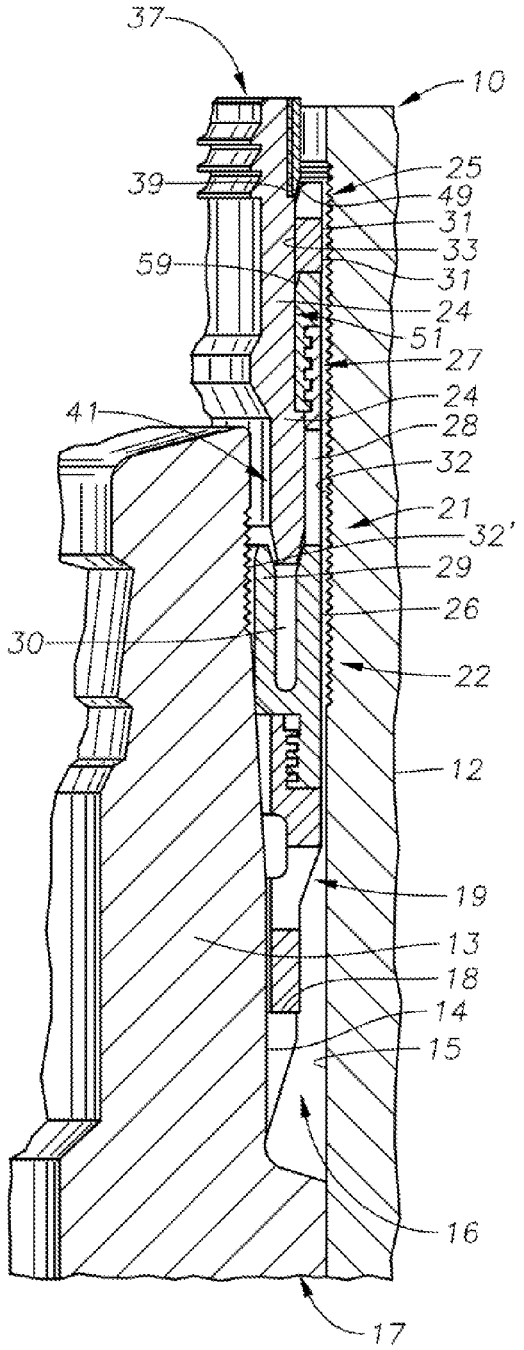
FIG. 6A is a sectional view of a seal assembly of a wellhead assembly in a pre-energized/lockdown state according to an embodiment of the present invention.
Figure 6B:
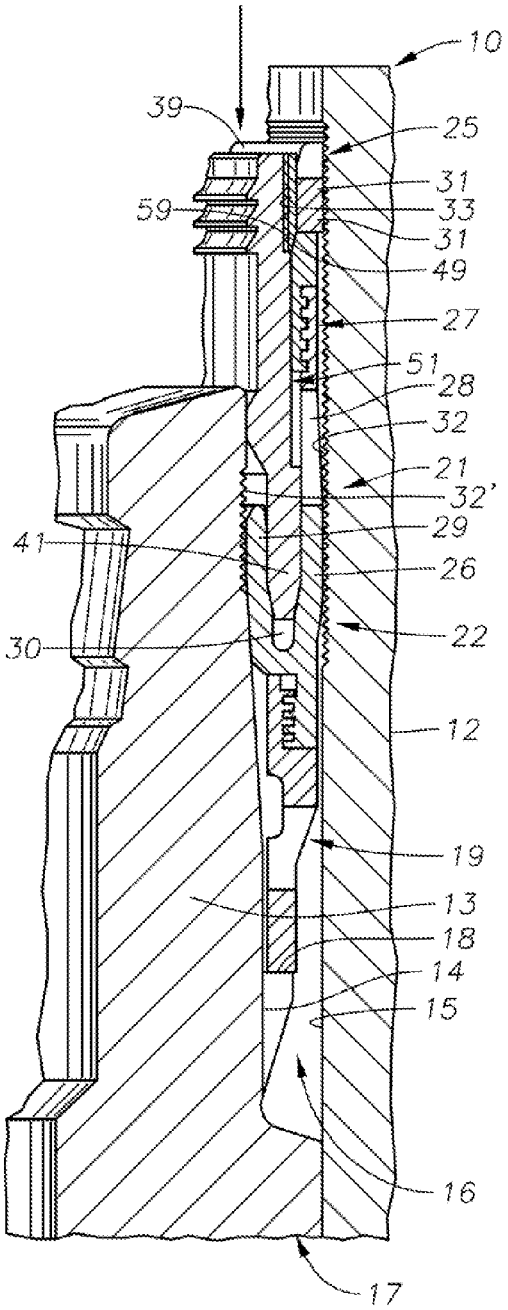
FIG. 6B is a sectional view of a seal assembly of a wellhead assembly in an energized/lockdown state according to an embodiment of the present invention.

The lockdown ring 25 also includes an inner diameter surface 33 for engaging the outer diameter surface portions 35 of the proximal end portion 37 of the energizing ring 24, and a tapered surface 39 tapered according to various methodologies to facilitate axial movement of the outer diameter surface 35 of the proximal end portion 37 of the energizing ring 24 into engagement with substantial portions of the inner diameter surface 33 of the lockdown ring 25 when axially translating a distal end portion of the energizing ring 24 comprising an energizer or energizer member 41 into the annular channel 30 of the seal 22 as shown, for example, in FIGS. 6A and 6B. That is, lockdown ring 25 is thicker at its base proximate to the annular retaining nut 23, and decreases above tapered/transition portion 39. The bottom of the lockdown ring 25 is relatively flat in order to interface with a top surface of the annular retaining nut 23. Other configurations as necessary to interface with annular nut 23 are, however, within the scope of the present invention. Note, lockdown ring 25 can also include a plurality of anti-rotation slots 43 having various sizes and depths. In the illustrated embodiment, for a ring 25 having a length of approximately one inch, the slots 43 would have a depth of approximately ⅜ of an inch.

Figure 5:
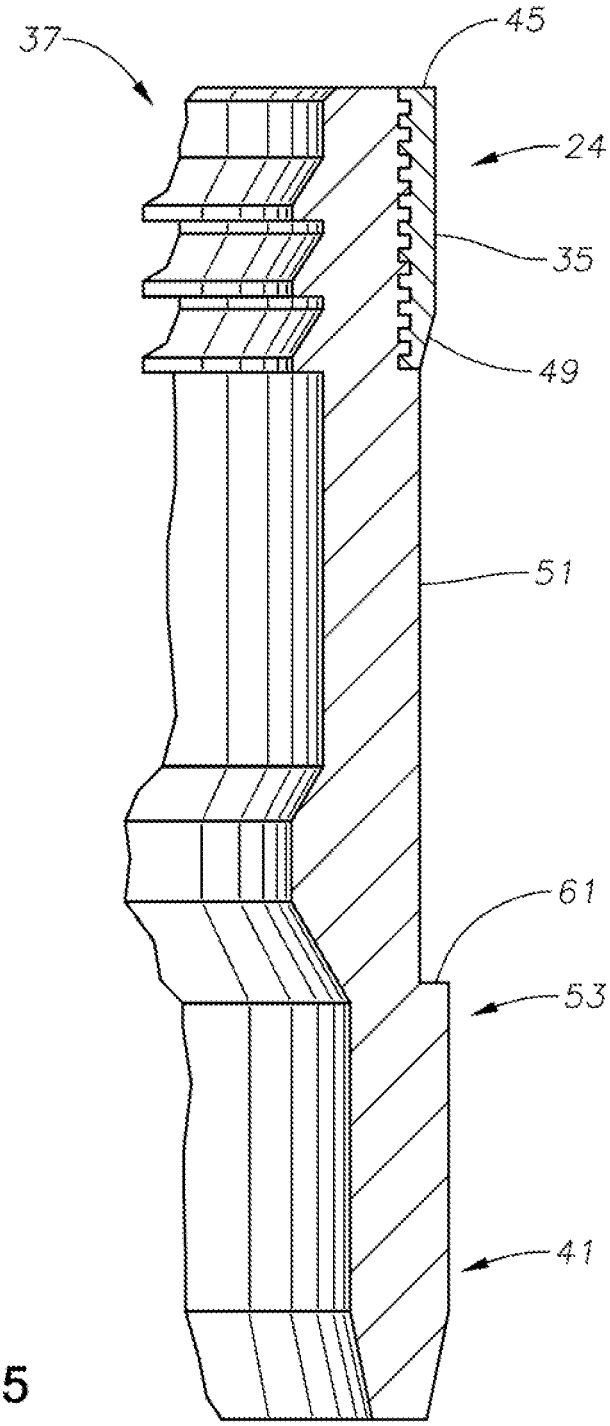
FIG. 5 is a sectional view of an energizing ring of a wellhead assembly according to an embodiment of the present invention.

As shown in FIGS. 2 and 5, and as noted above, the annular energizing ring 24 is also provided in the annulus 16. The energizing ring 24, particularly its proximal end 37, is dimensioned to radially outwardly compress substantial portions of the outer diameter surface 31 of the lockdown ring 25 into corresponding portions of the inner diameter surface 15 of the wellhead housing 12 and to energize the annulus seal 22. To this end, the proximal end portion 37 of the energizing ring 24 has an outer diameter/outer diameter surface 35 sized to engage substantial portions of the inner diameter surface 33 of the lockdown ring 25, according to various methodologies. Such methodologies can include the use of buildup material, integral or separate, initial manufacture design change, and/or application of an extension member or ring.

In the embodiment shown in FIG. 5, the outer diameter surface 35 of the proximal end portion 37 of the energizing ring 24 is provided through the addition of an annular radial extension (e.g., extension ring 45) extending the outer diameter surface 35 to the desired diameter. Beneficially, the annular radial extension enhances compression of the substantial portions of the lockdown ring 25 when axially translating the distal end portion of the energizing ring 24 into the annular channel 30 of the annulus seal 22. Other methodologies, such as, for example, forming a unitary structure as identified above, are, however, within the scope of the present invention. Also beneficially, the outer diameter surface 35 is at least substantially parallel to the outer diameter surface 31 and the inner diameter surface 33 of the lockdown ring 25 when positioned in full radial contact engagement with inner diameter surface 33 so that each pair of contacting surfaces (33, 35 and 15, 31) are devoid of urging forces that would disrupt the lockdown.

The energizing ring 24 also includes an adjacent tapered surface 49 complementing the tapered surface 39 of the lockdown ring 25 and tapered to facilitate axial movement of the outer diameter surface 35 of the energizing ring 24 into engagement with the substantial portions of the inner diameter surface 33 of the lockdown ring 25 when axially translating the energizer 41 of the energizing ring 24 into the annular channel 30 of the annulus seal 22. The tapered surface 49 can have an angle of approximately between 3° and 15° in relation to axis Ax of the wellhead housing 12.

As noted above, the distal end portion of the energizing ring 24 can include an energizer 41 sized to, e.g., simultaneously engage the outer and inner annular members 26, 29 of the annulus seal 22 when axially translating the energizer 41 into the annular channel 30 of the annulus seal 22. As will be discussed in further detail below, the energizer 41 is configured for insertion into the space/annular channel 30 to form a sealing surface for sealing between the casing hanger 13 and wellhead housing 12. Note, to enhance engagement of the outer and inner annular members, respectively, with the outer diameter surface 14 of casing hanger 13 and the inner diameter surface 15 of wellhead housing 12, wickers 32, 32' can be provided on the respective surfaces 14, 15 adjacent the respective outer and inner annular members 26, 29.

Still primarily referring to FIG. 5, a medial portion 51 of the energizing ring 24 has an outer surface diameter that is substantially less than the outer surface diameter of surface 35 of the energizing ring 24. As shown in FIG. 6A, this resulting recess beneficially provides space sufficient to accommodate the lockdown ring 25 prior to axially translating the energizer 41 into the annular channel 30 of the annulus seal 22 and associated lockdown of the lockdown ring 25 resulting from compressive contact of energizing ring surface 35 with lockdown ring surface 33. Note, in a preferred configuration, the outer diameter of the energizing ring surface 35 and the outer diameter of the upper section 53 of the distal end portion 41 of the energizing ring 24 are substantially or at least approximately the same or similar.

As shown in FIGS. 6A and 6B, in operation, energizing ring 24 is urged downward, for example, through employment of a running tool (not shown). Urging the energizing ring 24 downward pushes the energizer 41 into the space/channel 30. The energizer 41 thickness exceeds the thickness of the channel 30 so that the downward action results in pushing the inner member 29 and outer member 26 in opposite directions into sealing contact with both the casing hanger 13 and wellhead housing 12. The energizer 41 may fill all or a portion of the channel 30. Downwardly urging the energizing ring 24 also drives the tapered portion 49 of the energizing ring 24 over/along the tapered portion 39 of lockdown ring 25 (see FIG. 6A) until reaching the tapered complementing portion 59 of annular nut 23 (see FIG. 6B).

With respect to the axis Ax, the inner surface diameter of the lockdown ring 25 below the lockdown ring taper 39 is less than the diameter of outer diameter surface 35 of the energizing ring 24 above the energizing ring taper 49. Thus, as shown in FIG. 6B, downwardly moving the energizing ring 24 to push the energizing ring taper 49 below the lockdown ring taper 39 urges the outer diameter surface 31 of the lockdown ring 25 against the inner diameter surface 15 of the wellhead housing 12. This engages the outer diameter surface 31 of the lockdown ring 25 into the wickers 32 of the inner diameter surface 15 of the wellhead housing 12 with sufficient force to cause plastic deformation of the lockdown ring surface 31, "biting" into the wickers 32. Thus, enhancing lockdown of the seal assembly 21.

Accordingly, retaining the energizing ring 24 in the configuration illustrated in FIG. 6B, sustains engagement between the lockdown ring 25 and the casing hanger 13. This engagement with the corresponding surfaces 15, 31 on the wellhead housing 12 and lockdown ring 25, respectively, fixes the seal assembly 21 to the wellhead housing 12, thereby preventing relative movement between the seal assembly 21 and wellhead housing 12. Also, according to one embodiment of the present invention, portions of the main body of the lockdown ring 25 and/or proximal end portion 37 of the energizing ring 24 can be elastically deformed. This plastic deformation and/or combination of plastic and elastic deformation can beneficially assist in avoiding potential damage caused by relative movement between the seal assembly 21 and the wellhead housing 12 as a result of thermal expansion.

It should be pointed out that the corresponding wellhead and lockdown ring contact surfaces 15, 31, along with the outer surfaces of the outer seal member 26 lower portion, extension member 27, and retaining nut 23, may include many different configurations which meet their functional purposes. Nevertheless, in a preferred configuration, the inner diameter surface 15 of the wellhead includes a substantial array or set of annular grooves defining wickers 32, having a depth of typically on the order of $^{80}/_{1000}$ in. resulting in corresponding annular protuberances of a similar altitude having various shapes as would be recognized by those of ordinary skill in the art.

As shown in FIGS. 4 and 6A-7B, the wickers 32 are positioned within a window of expected axial positions of the seal assembly 21 when operationally employed within the wellhead housing 12 so as to remove a precise axial location requirement. Beneficially, removal of such restriction can allow for a wider range of tolerances regarding axial positioning and reduced manufacturing costs. Further, extending the wickers 32 to engage along a substantial length of the seal assembly 21 can result in improved lockdown force capabilities, particularly when used in conjunction with a modified energizing ring design that can provide plastic deformation of a lockdown ring surface into the wickers 32. Note, although shown as extending continuously between an upper potential location of the lockdown ring 25 and a lower portion of outer seal member 26, one of ordinary skill in the art would understand that separate sets of wickers 32 can be employed whereby a first set of wickers 32 is positioned to cover the potential range of axial positions of the lockdown ring 25 and a second set of wickers 32 is positioned axially adjacent wickers 32' to cover the potential range of axial positions of the outer and inner members 26, 29 of seal element 22.

Figure 7A:
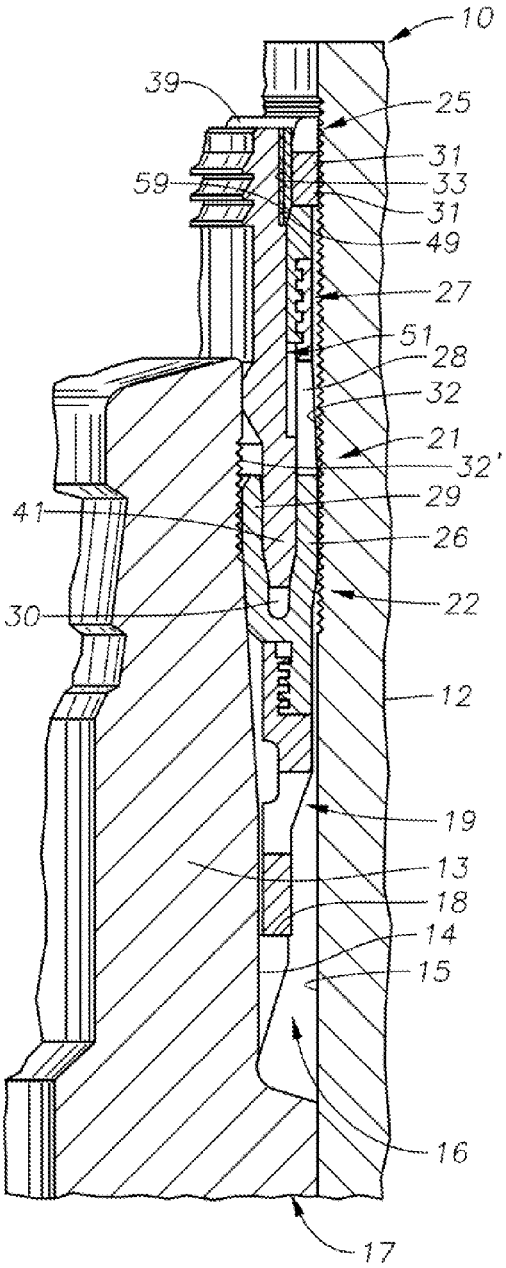
FIG. 7A is a sectional view of a seal assembly of a wellhead assembly in an energized/lockdown state according to an embodiment of the present invention.
Figure 7B:
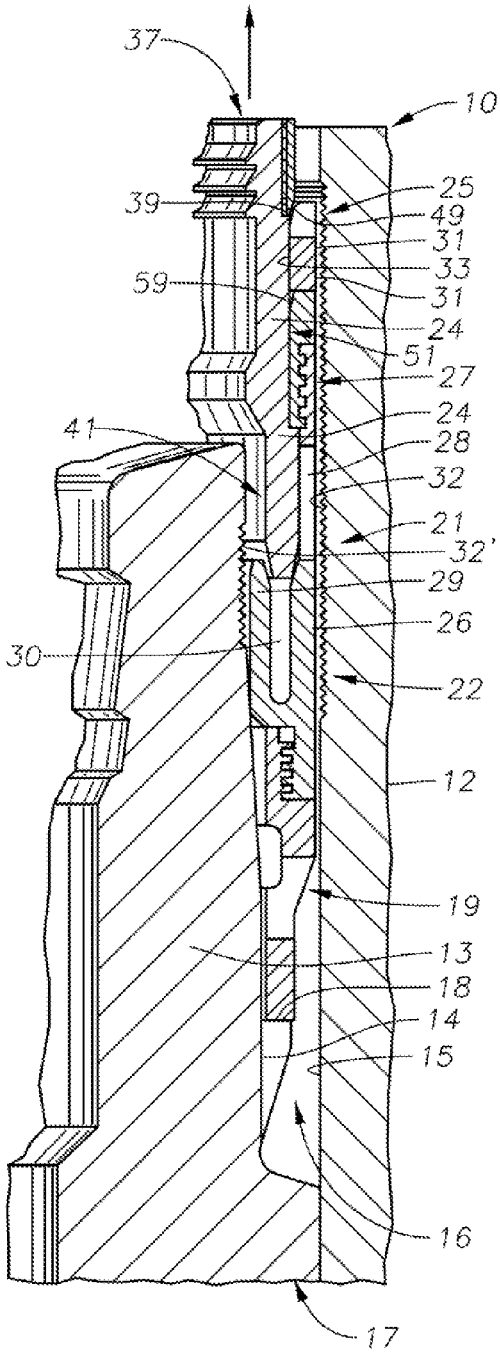
FIG. 7B is a sectional view of a seal assembly of a wellhead assembly in a post-energized, released from lockdown state according to an embodiment of the present invention.

Referring again to FIG. 5, the resulting diameter differential between medial portion surface 51 and distal end upper section 53 of energizing ring 24 can result in a shoulder 61 configured to engage the bottom surface portion 63 of retaining nut 23 during removal of the seal assembly 21. Now primarily referring to FIGS. 7A and 7B, during removal operations, energizing ring 24 is urged upward, for example, through employment of a running tool (not shown) from its lockdown position (see FIG. 7A). Urging the energizing ring 24 upward extracts the energizer 41 from within the space/channel 30. Upwardly urging the energizing ring 24 also results in energizing ring surface 35 sliding off lockdown ring surface 33 (see FIG. 7B), releasing the compressive lockdown forces between energizing ring surface 35 and wellhead surface 15, and results in lockdown ring 25 sliding into recessed energizing ring surface 51. Thus, as shown in FIG. 7B, upwardly moving the energizing ring 24 to pull the energizing ring surface 35 off lockdown ring surface 33 effectively releases lockdown ring surface 31 from wellhead surface 15. Further, with the lockdown ring 25 positioned within the gap formed between recessed energizing ring surface 51 and wellhead inner diameter surface 15, continued extraction forces results in the energizing ring shoulder 61 engaging the bottom surface 63 of the retaining nut 23. Still further forces and corresponding upward axial movement can result in the removal of the entire seal assembly 21 from within the wellhead 12.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification. For example, although primarily illustrated in the context of a casing hanger landed within a modified high-pressure wellhead housing, one of ordinary skill in the art will recognize that the featured seal assembly and methods can be readily employed with respect to tubing within modified casing or other tubing.

The invention claimed is:

1. A method of locking down an annulus seal disposed within an annulus between outer and inner wellhead members, the method comprising the steps of:

providing a seal assembly including an annulus seal, an annular lockdown ring, and an energizing ring, the energizing ring including a proximal end portion, a distal end portion, and a medical portion extending therebetween, the proximal end portion being longitudinally spaced apart from the distal end portion;

positioning the seal assembly in the annulus between outer and inner wellhead members;

axially translating the distal end portion of the energizing ring into an annular channel of the annulus seal, the distal end portion of the energizing ring radially compressing substantial portions of a first annular member of the annulus seal into engagement with an outer diameter surface of the inner wellhead member and radially compressing substantial portions of a second annular member of the annulus seal into engagement with an inner diameter surface of the outer wellhead member responsive to the axial translation of the energizing ring; and outer diameter surface portions of the proximal end portion of the energizing ring radially compressing substantial portions of the lockdown ring responsive to axially translating the energizing ring, substantial portions of the outer diameter surface of the lockdown ring plastically deforming onto a plurality of annular grooves of a set of annular grooves defining a set of wickers located on portions of the inner diameter surface of the outer wellhead member, the proximal end portion of the energizing ring being spaced apart from the annular channel of the annulus seal when the distal end portion of the energizing ring is operably positioned therein.

2. A method as defined in claim 1, wherein the inner wellhead member is a casing hanger;

wherein the outer wellhead member is a high-pressure wellhead housing; and wherein the annular lockdown ring comprises an outer diameter surface configured to engage adjacent portions of the inner diameter surface of the high-pressure wellhead housing having the set of wickers when operationally positioned therein, an inner diameter surface for engaging the outer diameter surface portions of the proximal end portion of the energizing ring, and a tapered surface tapered to facilitate axial movement of the outer diameter surface of the proximal end portion of the energizing ring into engagement with substantial portions of the inner diameter surface of the lockdown ring when axially translating the distal end portion of the energizing ring into the annular channel of the annulus seal.

3. A method as defined in claim 2, wherein the energizing ring is dimensioned to radially compress substantial portions of the outer diameter surface of the lockdown ring into corresponding portions of the inner diameter surface of the high-pressure wellhead housing and to energize the annulus seal, the energizing ring including:

the proximal end portion having the outer diameter surface sized to engage substantial portions of the inner diameter surface of the annular lockdown ring, an adjacent tapered surface complementing the tapered surface of the lockdown ring and tapered to facilitate axial movement of the outer diameter surface of the proximal end portion of the energizing ring into engagement with the substantial portions of the inner diameter surface of the lockdown ring when axially translating the distal end portion of the energizing ring into the annular channel of the annulus seal;

the distal end portion sized to simultaneously engage the first annular member and the second annular member of the annulus seal when axially translating the distal end portion of the energizing ring into the annular channel of the annulus seal; and the medial portion having an outer surface diameter that is less than the outer surface diameter of the proximal end portion of the energizing ring to accommodate the lockdown ring prior to axially translating the distal end portion of the energizing ring into the annular channel of the annulus seal.

4. A method as defined in claim 3, wherein the inner diameter surface portions of the high-pressure wellhead housing engaging the outer diameter surface portions of the lockdown ring and the inner diameter surface portions of the high-pressure wellhead housing engaging outer surface portions of the second annular member of the annulus seal when the annulus seal is energized, have an at least substantially same inner surface diameter;

wherein the energizing ring is axially translated downward to simultaneously energize the first and the second annular members of the annulus seal and outwardly radially compress the substantial portions of the lockdown ring into contact with the inner diameter surface of the outer wellhead member;

wherein the distal end portion of the energizing ring has an outer surface diameter that is greater than the diameter of outer diameter surface of the medial portion of the energizing ring to form a shoulder for engaging a retaining nut during removal of the seal assembly; and wherein the method further comprises removing the energizing ring from compressive engagement with the lockdown ring so that the lockdown ring and annulus seal simultaneously disengage from the inner diameter surface of the high-pressure wellhead housing to thereby remove the annulus seal from the annulus.

5. A method as defined in claim 1, wherein the proximal end portion of the energizing ring comprises an annular radial extension extending the outer diameter surface of the proximal end portion of the energizing ring so that adjacent outer diameter surface portions of the medial portion of the energizing ring have an outer surface diameter that is substantially less than the outer surface diameter of the proximal end portion of the energizing ring, the annular radial extension enhancing compression of the substantial portions of the lockdown ring when axially translating the distal end portion of the energizing ring into the annular channel of the annulus seal, and the reduced diameter of the outer diameter surface of the medial portion accommodating the lockdown ring prior to axially translating the distal end portion of the energizing ring into the annular channel of the annulus seal.

6. A method as defined in claim 1, wherein the seal assembly includes a retaining nut having a tapered surface complementing the tapered surface of the energizing ring and tapered so that when the distal end portion of the energizing ring is fully operationally inserted between the first and the second annular members of the annulus seal, the tapered surface of the energizing ring engages the tapered surface of the retaining nut; and wherein the second annular member comprises an annular extension, a proximal end of the annular extension configured to engage complementary portions of the retaining nut.

7. A method as defined in claim 1, wherein the set of wickers at least non-continuously extend between an outer diameter surface of at least a medial portion of the second annular member and a proximal portion of the outer diameter surface of the annular lockdown ring when the annulus seal is energized to thereby enhance retention of the seal assembly.

8. A seal assembly for locking down an annulus seal disposed within an annulus between outer and inner wellhead members, the seal assembly comprising:

an annulus seal having a first annular member configured to engage an outer diameter surface of an inner wellhead member, a second annular member configured to engage an inner diameter surface of an outer wellhead member, and an annular channel extending therebetween to receive an energizing member;

an annular lockdown ring having an outer diameter surface configured to engage adjacent portions of the inner diameter surface of the outer wellhead member having a plurality of shallow annular grooves defining a set of wickers when operationally positioned therein, an inner diameter surface to engage an outer diameter surface of an energizing ring, and a tapered surface tapered to facilitate axial movement of the outer diameter surface of the energizing ring into engagement with substantial portions of the inner diameter surface of the lockdown ring when axially translating a distal end portion of the energizing ring into the annular channel of the annulus seal; and the energizing ring dimensioned to radially compress substantial portions of the outer diameter surface of the lockdown ring into corresponding portions of the inner diameter surface of the outer wellhead member and to energize the annulus seal, the energizing ring including a proximal end portion having an outer diameter surface sized to engage substantial portions of the inner diameter surface of the annular lockdown ring to radially outwardly compress portions of the lockdown ring when axially translating the distal end portion of the energizing ring into the annular channel of the annulus seal, an adjacent tapered surface complementing the tapered surface of the lockdown ring and tapered to facilitate axial movement of the outer diameter surface of the proximal end portion of the energizing ring into engagement with the substantial portions of the inner diameter surface of the lockdown ring when axially translating the distal end portion of the energizing ring into the annular channel of the annulus seal, the distal end portion sized to simultaneously engage the first annular member and the second annular member of the annulus seal when axially translating the distal end portion of the energizing ring into the annular channel of the annulus seal, and a medial portion having an outer surface diameter that is less than the outer surface diameter of the proximal end portion of the energizing ring to accommodate the lockdown ring prior to axially translating the distal end portion of the energizing ring into the annular channel of the annulus seal.

9. A seal assembly as defined in claim 8, wherein the inner wellhead member is a casing hanger;

wherein the outer wellhead member is a high-pressure wellhead housing; and wherein the lockdown ring is further configured so that when the energizing ring is fully axially translated to energize the annulus seal, portions of the outer diameter surface of the lockdown ring plastically deform onto a plurality of wickers of the set of wickers located on portions of the inner diameter surface of the high-pressure wellhead housing.

10. A seal assembly as defined in claim 9, wherein the strength rating of the portion of the high-pressure wellhead housing engaging portions of the outer diameter surface of the lockdown ring is between approximately 80 KPsi and 120 Kpsi; and wherein the strength rating of portions of the outer diameter surface of the lockdown ring engaging the portions of the high-pressure wellhead housing is between approximately 30 Kpsi and 80 KPsi.

11. A seal assembly as defined in claim 9, wherein the proximal end portion of the energizing ring comprises an annular radial extension extending the outer diameter surface of the proximal end portion of the energizing ring so that adjacent outer diameter surface portions of a medial portion of the energizing ring have an outer surface diameter that is substantially less than the outer surface diameter of the proximal end portion of the energizing ring, the annular radial extension enhancing compression of the substantial portions of the lockdown ring when axially translating the distal end portion of the energizing ring into the annular channel of the annulus seal, the reduced diameter of the outer diameter surface of the medial portion accommodating the lockdown ring prior to axially translating the distal end portion of the energizing ring into the annular channel of the annulus seal; and wherein the distal end portion of the energizing ring has an outer surface diameter that is greater than the diameter of the outer diameter surface of the medial portion of the energizing ring to form a shoulder for engaging a retaining nut during removal of the seal assembly.

12. A seal assembly as defined in claim 8, further comprising:

a retaining nut having a tapered surface complementing the tapered surface of the energizing ring and tapered so that when the distal end portion of the energizing ring is fully operationally inserted between the first and second annular members of the annulus seal, the tapered surface of the energizing ring engages the tapered surface of the retaining nut; and wherein the second annular member comprises an annular extension, a proximal end of the annular extension configured to engage complementary portions of the retaining nut.

13. A seal assembly as defined in claim 8, wherein the tapered surface of the energizing ring is tapered at an angle of approximately between 3° and 15° in relation to a main axis of the outer wellhead member.

14. A seal assembly as defined in claim 8, wherein the set of wickers extend between an outer diameter surface of at least a medial portion of the second annular member and a proximal portion of the outer diameter surface of the annular lockdown ring when the annulus seal is energized to thereby enhance retention of the seal assembly.

15. A wellhead assembly, comprising:

an outer wellhead member adapted to be anchored in a borehole;

an inner wellhead member landed within the outer wellhead member, a gap between the outer wellhead member and the inner wellhead member defining an annulus;

a profile on an interior surface of the outer wellhead member comprising a plurality of shallow annular grooves, protuberances, or grooves and protuberances defining a set of wickers; and a seal assembly comprising:

an annulus seal having a first annular member configured to engage an outer diameter surface of the inner wellhead member, a second annular member configured to engage an inner diameter surface of the outer wellhead member, and an annular channel extending therebetween to receive an energizing member, an annular lockdown ring having an outer diameter surface configured to engage adjacent portions of an inner diameter surface of the outer wellhead member having the set of wickers when operationally positioned therein, an inner diameter surface to engage an outer diameter surface of an energizing ring, and a tapered surface tapered to facilitate axial movement of the outer diameter surface of the energizing ring into engagement with substantial portions of the inner diameter surface of the lockdown ring when axially translating a distal end portion of the energizing ring into the annular channel of the annulus seal, and the energizing ring dimensioned to radially compress substantial portions of the outer diameter surface of the lockdown ring into corresponding portions of the inner diameter surface of the outer wellhead member and to energize the annulus seal, the energizing including a proximal end portion having an outer diameter surface sized to engage substantial portions of the inner diameter surface of the annular lockdown ring to radially outwardly compress portions of the lockdown ring when axially translating the distal end portion of the energizing ring into the annular channel of the annulus seal, an adjacent tapered surface complementing the tapered surface of the lockdown ring and tapered to facilitate axial movement of the outer diameter surface of the proximal end portion of the energizing ring into engagement with the substantial portions of the inner diameter surface of the lockdown ring when axially translating the distal end portion of the energizing ring into the annular channel of the annulus seal, the distal end portion sized to simultaneously engage the first annular member and the second annular member of the annulus seal when axially translating the distal end portion of the energizing ring into the annular channel of the annulus seal, and a medial portion having an outer surface diameter that is less than the outer surface diameter of the proximal end portion of the energizing ring to accommodate the lockdown ring prior to axially translating the distal end portion of the energizing ring into the annular channel of the annulus seal.

16. A wellhead assembly as defined in claim 15, wherein the inner wellhead member is a casing hanger;

wherein the outer wellhead member is a high-pressure wellhead housing; and wherein the lockdown ring is further configured so that when the energizing ring is fully axially translated to energize the annulus seal, portions of the outer diameter surface of the lockdown ring plastically deform onto a plurality of wickers of the set of wickers located on portions of the inner diameter surface of the high-pressure wellhead housing.

17. A wellhead assembly as defined in claim 15, wherein the strength rating of the portion of the high-pressure wellhead housing engaging portions of the outer diameter surface of the lockdown ring is between approximately 80 KPsi and 120 Kpsi; and wherein the strength rating of portions of the outer diameter surface of the lockdown ring engaging the portions of the high-pressure wellhead housing is between approximately 30 Kpsi and 80 KPsi.

18. A wellhead assembly as defined in claim 15, wherein the proximal end portion of the energizing ring comprises an annular radial extension extending the outer diameter surface of the proximal end portion of the energizing ring so that adjacent outer diameter surface portions of a medial portion of the energizing ring have an outer surface diameter that is substantially less than the outer surface diameter of the proximal end portion of the energizing ring, the annular radial extension enhancing compression of the substantial portions of the lockdown ring when axially translating the distal end portion of the energizing ring into the annular channel of the annulus seal, the reduced diameter of the outer diameter surface of the medial portion accommodating the lockdown ring prior to axially translating the distal end portion of the energizing Ting into the annular channel of the annulus seal; and wherein the distal end portion of the energizing ring has an outer surface diameter that is greater than the diameter of the outer diameter surface of the medial portion of the energizing ring to form a shoulder for engaging a retaining nut during removal of the seal assembly.

19. A wellhead assembly as defined in claim 15, wherein the seal assembly includes a retaining nut having a tapered surface complementing the tapered surface of the energizing ring and tapered so that when the distal end portion of the energizing ring is fully operationally inserted between the first and second annular members of the annulus seal, the tapered surface of the energizing ring engages the tapered surface of the retaining nut; and wherein the second annular member comprises an annular extension, a proximal end of the annular extension configured to engage complementary portions of the retaining nut.

20. A wellhead assembly as defined in claim 15, wherein the tapered surface of the energizing ring is tapered at an angle of approximately between 3° and 15° in relation to a main axis of the outer wellhead member.

21. A wellhead assembly as defined in claim 15, wherein the set of wickers extend between an outer diameter surface of at least a medial portion of the second annular member and a proximal portion of the outer diameter surface of the annular lockdown ring when the annulus seal is energized to thereby enhance retention of the seal assembly within the wellhead assembly.

* * * * *